US011268748B2

(12) United States Patent
McCollough et al.

(10) Patent No.: US 11,268,748 B2
(45) Date of Patent: Mar. 8, 2022

(54) INDIRECT AIR COOLING FOR AN ICE MAKER WITHIN A REFRIGERATOR DOOR

(71) Applicant: Electrolux Home Products, Inc., Charlotte, NC (US)

(72) Inventors: Thomas McCollough, Anderson, SC (US); Keith Phelan, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 244 days.

(21) Appl. No.: 16/539,106

(22) Filed: Aug. 13, 2019

(65) Prior Publication Data

US 2021/0048237 A1 Feb. 18, 2021

(51) Int. Cl.

| | |
|---|---|
| ***F25C 1/24*** | (2018.01) |
| ***F25D 17/06*** | (2006.01) |
| ***F25C 5/20*** | (2018.01) |
| ***F25D 17/08*** | (2006.01) |
| ***F25D 23/12*** | (2006.01) |
| ***F25D 23/06*** | (2006.01) |

(52) U.S. Cl.

CPC ..... *F25D 17/065* (2013.01); *F25C 1/24* (2013.01); *F25C 5/22* (2018.01); *F25D 17/067* (2013.01); *F25D 17/08* (2013.01); *F25D 23/069* (2013.01); *F25D 23/126* (2013.01); *F25C 2400/10* (2013.01); *F25D 2317/067* (2013.01); *F25D 2317/068* (2013.01); *F25D 2400/04* (2013.01)

(58) Field of Classification Search

CPC ..... F25C 1/24; F25C 2400/10; F25C 5/22; F25D 11/025; F25D 17/065; F25D 17/067; F25D 17/08; F25D 2317/061; F25D 2317/062; F25D 2317/067; F25D 2317/068; F25D 23/069; F25D 23/126; F25D 2400/04

See application file for complete search history.

(56) References Cited

U.S. PATENT DOCUMENTS

| | | | | |
|---|---|---|---|---|
| 8,499,577 | B2 * | 8/2013 | Watson | F25D 23/126 62/340 |
| 8,794,014 | B2 * | 8/2014 | Kulkarni | F25D 11/025 62/66 |
| 9,200,828 | B2 * | 12/2015 | Mitchell | F25C 5/22 |

(Continued)

*Primary Examiner* — Filip Zec
(74) *Attorney, Agent, or Firm* — Pearne & Gordon LLP

(57) ABSTRACT

A refrigerator includes a cabinet defining a storage compartment therein, a door that provides selective access to the storage compartment, and an ice maker provided in the door. An air duct directs a flow of air from an insulated chamber to the ice maker. An air cooling system cools air inside the insulated chamber and comprises a first non-evaporative heat exchanger positioned independent of and adjacent to an evaporator, a second non-evaporative heat exchanger provided within the insulated chamber, and a fluid line that directs a circulation of fluid between the first and second non-evaporative heat exchangers. The first non-evaporative heat exchanger is provided in heat exchanging relationship with the evaporator to cool the fluid positioned in the first non-evaporative heat exchanger, and the second non-evaporative heat exchanger is provided in heat exchanging relationship with the air inside the insulated chamber to cool the air therein.

20 Claims, 15 Drawing Sheets

(56) References Cited

U.S. PATENT DOCUMENTS

| | | | | |
|---|---|---|---|---|
| 2009/0151375 | A1* | 6/2009 | Tarr | F25D 11/025 62/180 |
| 2014/0150457 | A1* | 6/2014 | Boarman | F25C 1/04 62/3.3 |
| 2014/0150486 | A1* | 6/2014 | Boarman | F25C 5/08 62/344 |

* cited by examiner

INDIRECT AIR COOLING FOR AN ICE MAKER WITHIN A REFRIGERATOR DOOR

CROSS-REFERENCE TO RELATED APPLICATIONS

None

FIELD OF THE INVENTION

This application relates generally to an ice maker positioned within a refrigerator, and more particularly, indirect air cooling supplied to said ice maker.

BACKGROUND OF THE INVENTION

Conventional refrigeration applications, such as domestic refrigerators, typically have both a fresh food compartment and a freezer compartment. The fresh food compartment is where food items such as fruit, vegetables, and beverages are stored and the freezer compartment is where food items that are to be kept in a frozen condition are stored. The compartments are generally separated by a partition that is either vertically or horizontally oriented depending on the specific configuration of that refrigerator.

It is common for ice makers to be installed within the fresh food compartment. However, the operational temperature of the fresh food compartment is generally unsatisfactory for ice piece production. As such, air from the freezer compartment is directed directly from the freezer to the ice maker. However, this solution brings about its own issues. For example, additional manufacturing steps are required to produce and install air ducts as well as insulation materials associated with said ducts. This adds cost and complexity to the overall design of the refrigerator.

BRIEF SUMMARY OF THE INVENTION

In accordance with one aspect, there is provided a refrigerator comprising a cabinet defining a storage compartment therein. A door provides selective access to the storage compartment, and an ice maker is provided in the door. An air duct directs a flow of air from an insulated chamber to the ice maker. The refrigerator further includes an evaporator and an air cooling system that cools air inside the insulated chamber. The air cooling system includes a first non-evaporative heat exchanger positioned independent of and adjacent to the evaporator, and a second non-evaporative heat exchanger provided within the insulated chamber. A fluid line directs a circulation of fluid between the first and second non-evaporative heat exchangers, the first non-evaporative heat exchanger provided in heat exchanging relationship with the evaporator to cool the fluid positioned in the first non-evaporative heat exchanger. The second non-evaporative heat exchanger is provided in heat exchanging relationship with the air inside the insulated chamber to cool the air therein.

In accordance with another aspect, there is provided a bottom mount refrigerator having a fresh food compartment separated from and disposed above a freezer compartment. The refrigerator includes a cabinet defining a storage compartment including the fresh food compartment and the freezer compartment. An ice maker is provided in a door that provides selective access to the fresh food compartment or the freezer compartment. An air duct is provided at the fresh food compartment and directs a flow of air from an insulated chamber provided in the fresh food compartment to the ice maker. The refrigerator further includes an evaporator located within the freezer compartment, and an air cooling system that cools air inside the insulated chamber. The air cooling system includes a first non-evaporative heat exchanger provided within the freezer compartment, independent of and adjacent to the evaporator, and a second non-evaporative heat exchanger spaced from the first heat exchanger and disposed within the insulated chamber. A fluid line directs a circulation of fluid between the first and second non-evaporative heat exchangers. The first non-evaporative heat exchanger is provided in heat exchanging relationship with the evaporator to cool the fluid positioned in the first non-evaporative heat exchanger. The second non-evaporative heat exchanger is provided in heat exchanging relationship with the air inside the insulated chamber to cool the air therein.

In accordance with yet another aspect, there is provided a method of providing cold air to an ice maker provided in a door of a fresh food compartment. The method comprises the steps of circulating a liquid between a first non-evaporative heat exchanger and a second non-evaporative heat exchanger. The first non-evaporative heat exchanger is positioned independent of and adjacent to an evaporator located within a freezer compartment. The second non-evaporative heat exchanger is provided in an insulated chamber located within the fresh food compartment. The method further includes the step of cooling a portion of said liquid via heat exchange with the evaporator. The cooled portion of said liquid is located within the first non-evaporative heat exchanger. The cooled portion of said liquid is transported from the first non-evaporative heat exchanger to the second non-evaporative heat exchanger. The method also includes cooling air located within the insulated chamber via heat exchange between the cooled portion of said liquid and the air located within the insulated chamber, and directing a flow of said cooled air from the insulated chamber to the ice maker via an air duct.

DESCRIPTION OF EXAMPLE EMBODIMENTS

Figure 1:
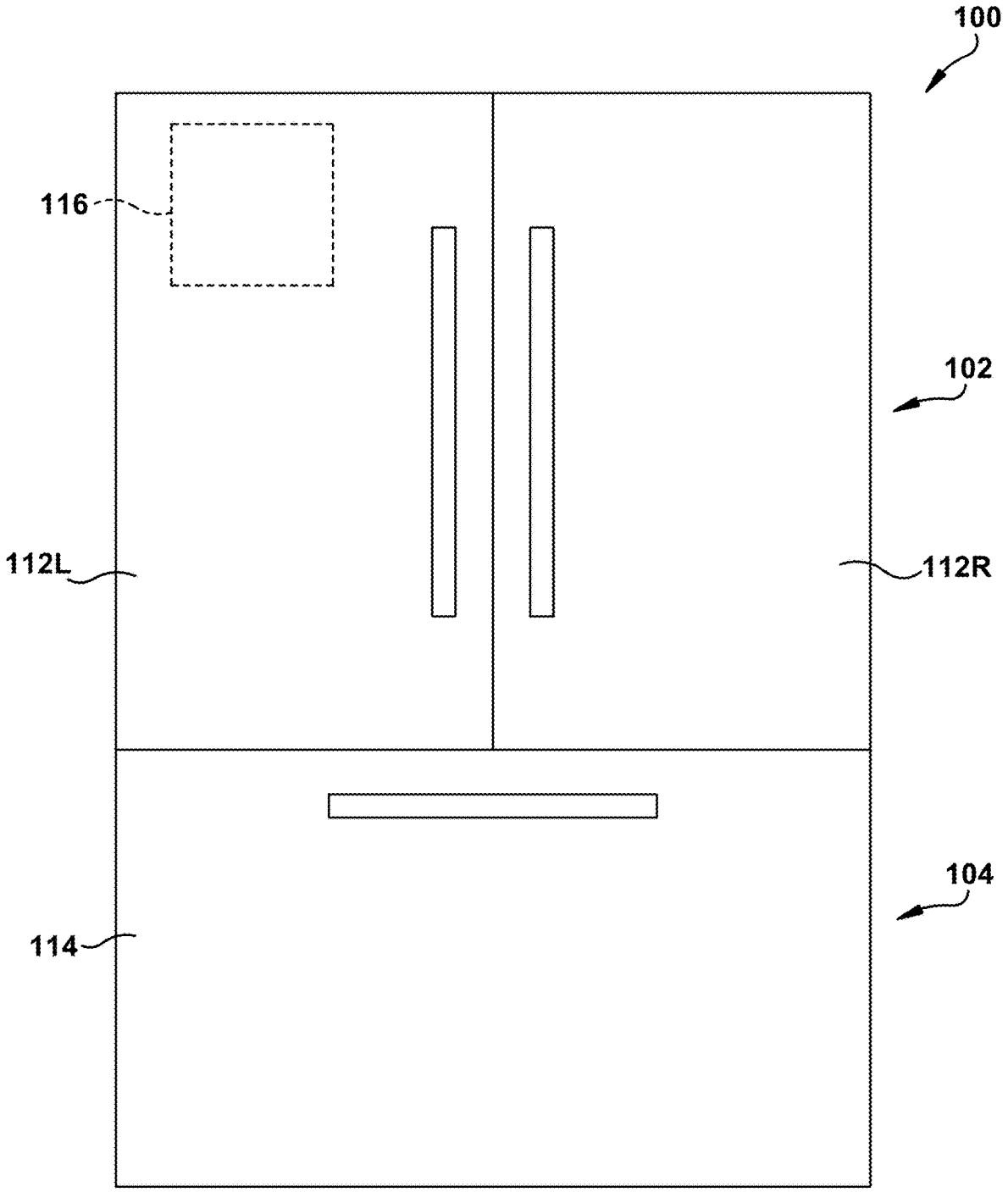
FIG. 1 is a front schematic view of a refrigerator.
Figure 4:
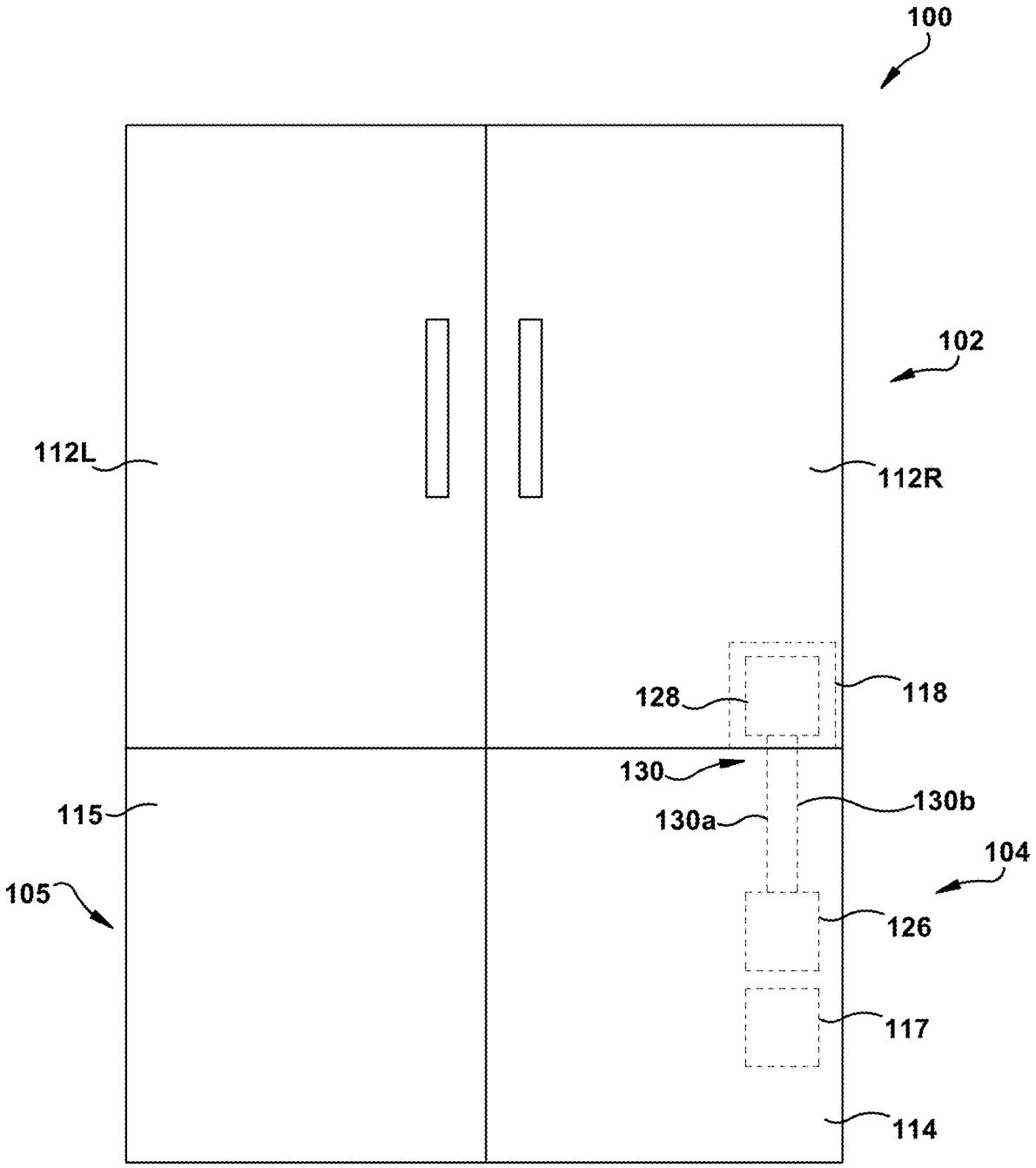
FIG. 4 is a front schematic view of an alternative refrigerator employing the air cooling system in FIG. 2A.

Referring now to the drawings, FIG. 1 depicts a refrigeration appliance in the form of a domestic refrigerator, indicated generally at 100. Although the detailed description that follows concerns a domestic refrigerator 100, the invention can be embodied by refrigeration appliances other than a domestic refrigerator 100. Further, an embodiment is described in detail below, and shown in the figures as a bottom-mount configuration of a refrigerator 100, including a fresh food compartment 102 disposed vertically above a freezer compartment 104. It is to be understood that other configurations are contemplated, for example, a top-mount refrigerator (i.e., fresh food compartment disposed vertically below the freezer compartment), a side by side refrigerator (i.e., fresh food compartment disposed laterally adjacent the freezer compartment), a single compartment refrigerator (i.e., having only a fresh food compartment or a freezer compartment), refrigerators including variable climate zone compartments, etc., as will be detailed below with reference to FIGS. 4 and 5.

Figure 2A:
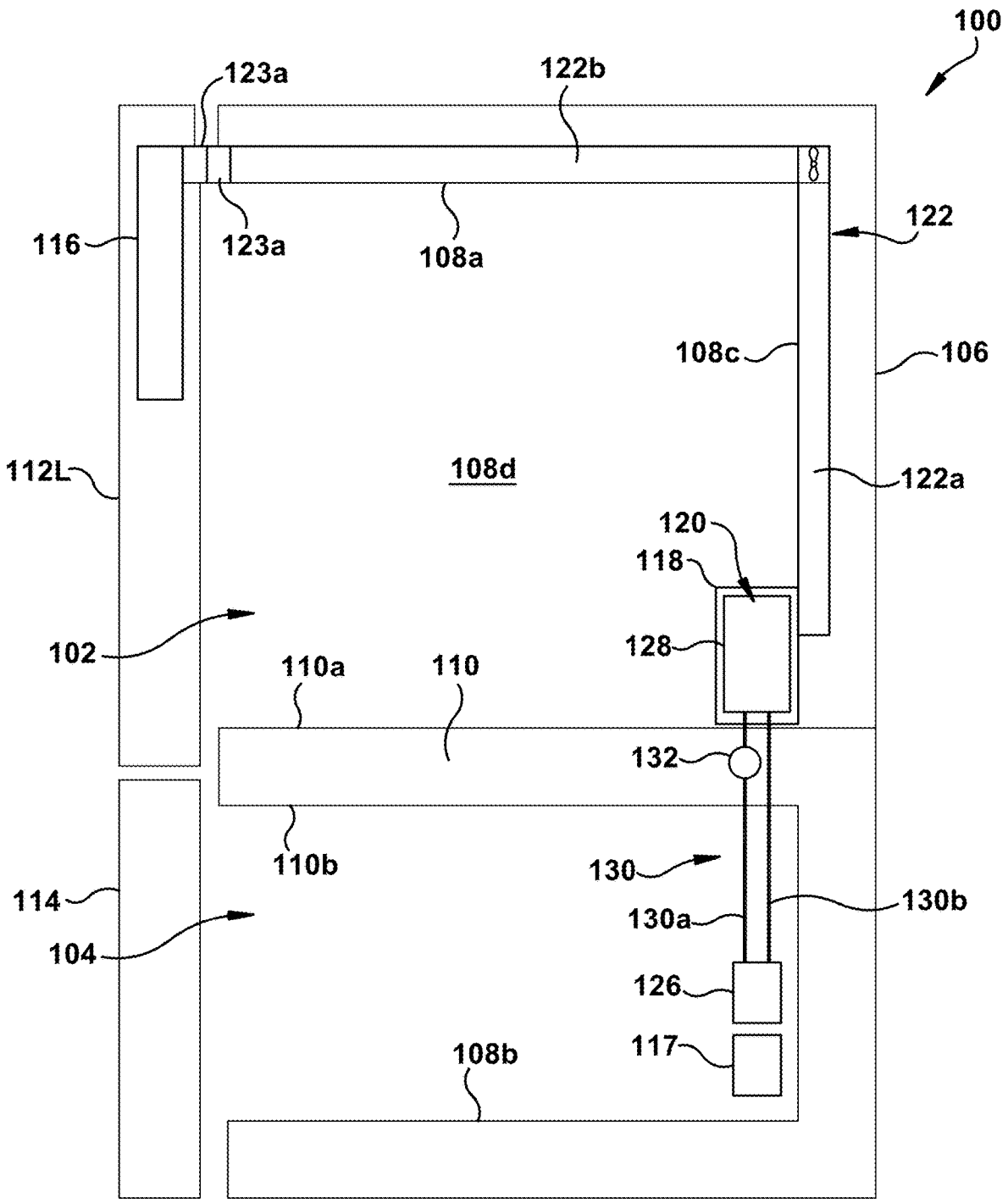
FIG. 2A is a side cross-sectional schematic view of the refrigerator depicted in FIG. 1.

As shown in FIGS. 1 and 2A, the refrigerator 100 includes a cabinet that defines a storage compartment therein; the storage compartment comprising the fresh food and the freezer compartments 102, 104. The cabinet includes an inner liner that is partially enclosed by a structural outer housing 106, with an insulation material therebetween. The inner liner comprises a top wall 108*a*, a bottom wall 108*b*, a rear wall 108*c*, and a pair of opposing side walls 108*d* (FIG. 2A only showing one of the opposing side walls 108*d*). A horizontal mullion 110 is disposed within the cabinet and is oriented parallel with respect to an imaginary plane on which the top and/or bottom walls 108*a*, 108*b* of the liner lie. Specifically, the horizontal mullion 110 includes top and bottom surfaces 110*a*, 110*b*. The horizontal mullion 110 vertically separates the storage compartment into the fresh food compartment 102 and the freezer compartment 104 such that the fresh food and freezer compartments 102, 104 are independently operable at varying temperatures. The freezer compartment 104 is used to freeze and/or maintain articles of food stored in the freezer compartment 104 in a frozen condition. For this purpose, the freezer compartment 104 is in thermal communication with a freezer evaporator (not shown) that removes thermal energy from the freezer compartment 104 to maintain the temperature therein at a temperature of 0° C. or less during operation of the refrigerator, preferably between 0° C. and −50° C., more preferably between 0° C. and −30° C. and even more preferably between 0° C. and −20° C.

At least one door permits a user to access the storage compartment of the refrigerator 100. Specifically, the fresh food and freezer compartments 102, 104 are selectively accessible via fresh food and freezer doors 112, 114, respectively. For example, as shown in FIG. 1, the fresh food compartment 102 is selectively accessible via a left-hand and a right-hand fresh food doors 112L, 112R, that are rotatably attached to opposite respective sides of the cabinet. In this manner, the left-hand and right-hand fresh food doors 112L, 112R are independently moveable with respect to one another to provide access to different portions of the fresh food compartment 102. The freezer door 114 is shown as being a drawer-type door, wherein the freezer door 114 is translationally moveable into and out of the freezer compartment 104 (e.g., via telescoping slides). It is to be understood that the amount and/or structure of the fresh food and freezer doors 112, 114 is not limited to the above disclosure and that other configurations are contemplated. For example, the fresh food compartment 102 may include only a single door. In addition or alternatively, the freezer compartment 104 may include one or more swing doors. It is further contemplated that the invention described herein could also be utilized in a side-by-side refrigerator, or even a single cabinet refrigerator device.

Figure 2B:
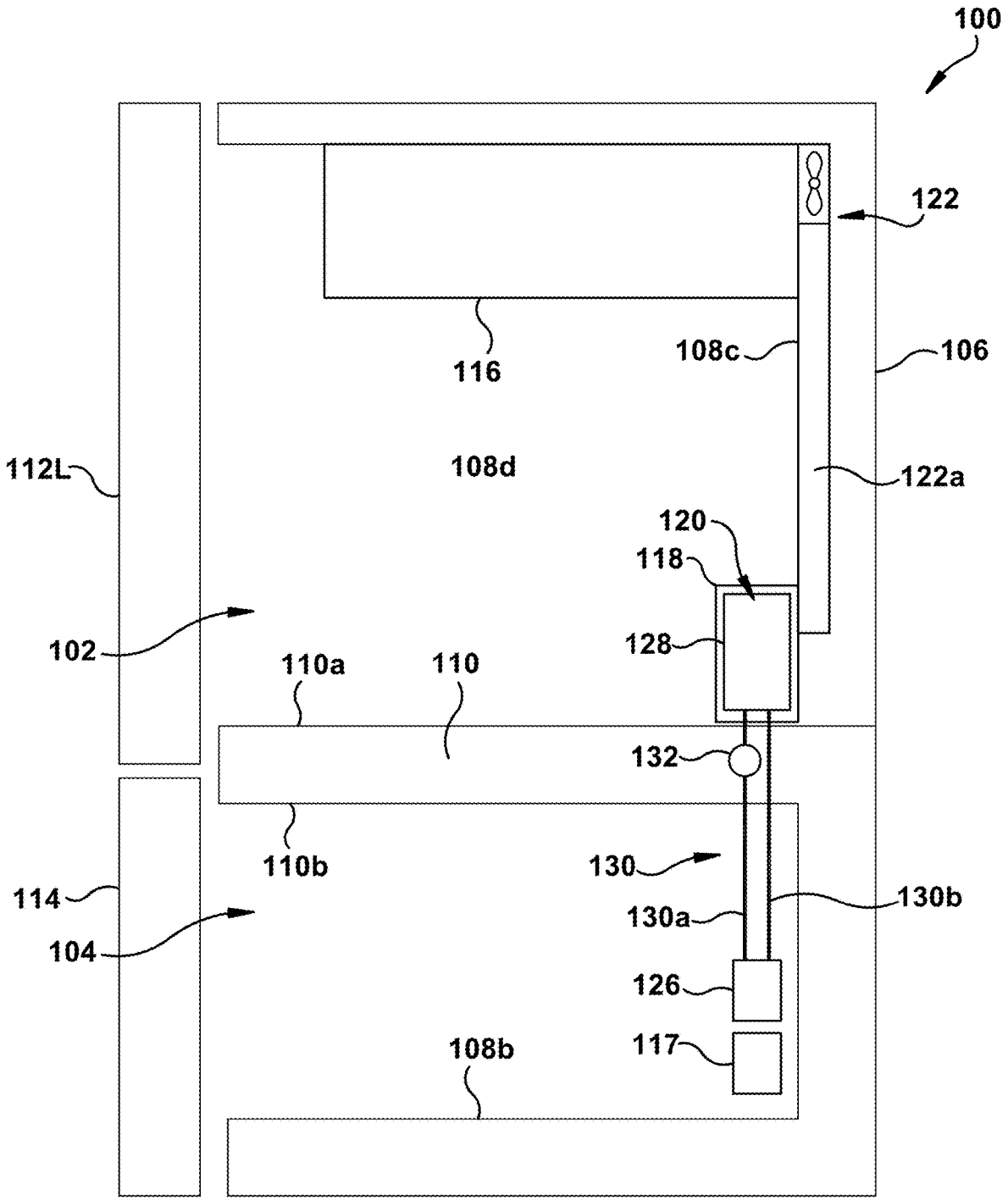
FIG. 2B is a side cross-sectional schematic view of an alternative refrigerator.

As shown in FIG. 2A, an ice maker 116 is provided within the refrigerator 100 and is disposed in the door that provides selective access to the storage compartment. That is, the ice maker 116 is provided in a door that provides selective access to the fresh food compartment 102 or the freezer compartment 104. As shown in FIGS. 1 and 2A, the ice maker 116 is provided within the left-hand fresh food door 112L. Alternatively, the ice maker 116 can be provided in the right-hand fresh food door 112R. Further still, as depicted in FIG. 2B, the ice maker 116 may alternatively be provided entirely within the fresh food compartment 102. The ice maker 116 receives water from an external source (or an internal source) in order to manufacture ice pieces therein. Those ice pieces can then be transported to a designated storage bin (not shown) or to a dispenser (not shown) provided at the left-hand fresh food door 112L, right-hand fresh food door 112R, and/or the freezer door 114. It is contemplated that the ice mold and ice bin can be separated elements, in which one remains within the fresh food compartment 102 and the other is on one of the fresh food doors 112L, 112R. Alternatively, it is contemplated that both the ice mold and the ice bin may be located entirely within the fresh food compartment 102.

As shown in FIG. 2A, the refrigerator 100 includes at least one evaporator housed therein that is configured to cool the storage compartment. Specifically, a freezer evaporator 117 is disposed within the freezer compartment 104 and is configured to cool the space defined therein. Although not shown, the refrigerator 100 can additionally include a separate fresh food evaporator located within the fresh food compartment 102 that is configured to cool the space defined therein, such that the fresh food and freezer compartments 102, 104 are independently cooled via separate evaporators.

An insulated chamber 118 is located within the fresh food compartment 102 and defines a cooling area 120 therein. The cooling area 120 is insulated by rigid foam insulation (e.g., expanded polystyrene, expanded polypropylene, expanded polyethylene, etc.), or even a blown expanding foam, such that a temperature of the cooling area 120 is isolated from a temperature of the fresh food compartment 102. Preferably, the cooling area 120 is maintained at a temperature lower than the fresh food compartment 102. The insulated chamber 118 is positioned adjacent the rear wall 108*c* of the liner and the top surface 110*a* of the horizontal mullion 110.

The refrigerator 100 further includes an air duct 122 that directs a flow of air from the insulated chamber 118 to the ice maker 116. That is, the ice maker 116 is provided in fluid communication with the insulated chamber 118 via the air duct 122. As further shown, a first gasket 123*a* is disposed at an outlet of the air duct 122 and a second gasket 123*b* is positioned at an inlet of the ice maker 116. The first and second gaskets 123*a*, 123*b* are provided to fluidly connect the air duct 122 and the ice maker 116 when the left-hand fresh food door 112L is in a closed position. In this manner, as will be further described below, the ice maker 116 receives cool air from the insulated chamber 118 for ice piece manufacturing. Further, a fan 124 is disposed at the air duct 122 and is configured to actively drive the flow of air directed therethrough. Preferably, the fan 124 is positioned within the air duct 122, but may alternatively be provided at other locations (e.g., within the cooling area 120, within the ice maker 116, etc.).

The air duct 122 is positioned about a section of the cabinet that defines the fresh food compartment 102. That is, with respect to FIG. 2A, the air duct 122 includes first and second sections 122*a*, 122*b* disposed adjacent the rear and top walls 108*c*, 108*a* of the liner, respectively. It is to be understood that the air duct 122 can include different sections and orientations. For example, the air duct 122 can be positioned adjacent the rear wall 108*c* and one of the opposing side walls 108*d* of the liner. Further, while the air duct 122 is shown as being disposed intermediate the liner and the outer housing 106, it is contemplated that the air duct 122 can be positioned at least partially, or entirely, within the fresh food compartment 102 such that the air duct 122 is provided adjacent a surface of the liner directed towards a center of the fresh food compartment 102.

In the alternative embodiment depicted in FIG. 2B, the air duct 122 comprises only the first section 122*a* disposed adjacent the rear wall 108*c* of the liner. Alternatively, the first section 122*a* can be positioned adjacent one of the opposing side walls 108*d* of the liner. Further, it is contemplated that the air duct 122 can be positioned at least partially, or entirely, within the fresh food compartment 102 such that the air duct 122 is provided adjacent a surface of the liner directed towards a center of the fresh food compartment 102.

An air cooling system is provided within the refrigerator 100 and is configured to cool air housed within the cooling area 120. The air cooling system includes a first heat exchanger 126, a second heat exchanger 128, and a fluid line 130 that directs a circulation of fluid therebetween. Preferably, the first and second heat exchangers 126, 128 are non-evaporative heat exchangers. That is, the fluid (i.e., liquid) circulating therebetween does not change state (i.e., the liquid does not evaporate). The first and second heat exchanges 126, 128 are separate and independent from the freezer evaporator 117, but are arranged in a heat exchanging relationship with the freezer evaporator 117. The first heat exchanger 126 is located adjacent an evaporator; specifically, as shown in FIG. 2A, the first heat exchanger 126 is positioned within the freezer compartment 104 and is disposed adjacent the freezer evaporator 117. In this manner, the first heat exchanger 126 is provided in heat exchanging relationship with the freezer evaporator 117 to cool the fluid positioned in the first heat exchanger 126. Although illustrated that the first heat exchanger 126 is positioned above the freezer evaporator 117, it is contemplated that the relative orientation of these devices may vary. In various examples, the first heat exchanger 126 could be positioned on top, underneath, to the side, in front of, or behind the freezer evaporator 117.

While it is shown that the first heat exchanger 126 is disposed adjacent and provided in heat exchanging relationship with the freezer evaporator 117, it is contemplated that the first heat exchanger 126 may be placed adjacent to a separate evaporator (not shown) located within the freezer compartment 104. That is, the air cooling system can include a stand-alone evaporator that is separate and distinct from a dedicated freezer and/or fresh food evaporator.

The second heat exchanger 128 is provided within the cooling area 120 of the insulated chamber 118 such that the second heat exchanger 128 is provided in heat exchanging relationship with the air housed within the cooling area 120. The cooling area 120 receives air to be cooled (by the second heat exchanger 128) from the duct 122, or from the fresh food compartment 102. The cooling area 120 does not receive air from the freezer compartment 104. That is, the second heat exchanger 128 is positioned within the insulated chamber 118 and configured to cool the air housed therein via heat exchange between said air and the fluid within the second heat exchanger 128. The fluid circulating within the fluid line 130 is preferably a pumpable liquid, and more specifically, can be glycol or the like with a high capacity for heat capture and transfer.

The first and second heat exchangers 126, 128 are formed integrally with the fluid line 130 such that each of the first and second heat exchangers 126, 128 is formed as part of the fluid line 130. Alternatively, the first and second heat exchangers 126, 128 can be separate and distinct elements with respect to the fluid line 130 (e.g., via brazed tubing, permanent/removable mechanical pipe connections, etc.). Preferably, the system would include service access ports to the various components for repair, replacement, etc.

As further shown in FIG. 2A, the fluid line 130 passes through the horizontal mullion 110 such that the fluid line 130 is positioned within both the fresh food and freezer compartments 102, 104. That is, the fluid line 130 extends through the top and bottom surfaces 110*a*, 110*b* of the horizontal mullion 110. Moreover, the fluid line 130 includes a first pipe 130*a* that directs the fluid from the first heat exchanger 126 to the second heat exchanger 128, and a second pipe 130*b* that directs the fluid from the second heat exchanger 128 back to the first heat exchanger 126. Further still, a pump 132 is placed in fluid communication with the fluid line 130 and is configured to circulate the fluid within the fluid line 130. As shown, the pump 132 is connected to the first pipe 130*a* and is disposed within the horizontal mullion 110. That is, the pump 132 is disposed between the top and bottom surfaces 110*a*, 110*b* of the horizontal mullion 110. Alternatively, the pump 132 could be located within the fresh food compartment, and is preferably located at a region which is readily serviceable for repair.

With reference to FIGS. 3A-3D, a method of providing cold air to the ice maker 116 will now be discussed. Of note, various elements of the refrigerator are depicted with shading to represent a relative temperature of either air or fluid (i.e., liquid). For simplicity, a legend is provided for FIGS. 3A-3D to emphasize the denotation of the various shadings. Moreover, reference to the fluid within the fluid line 130, the first heat exchanger 126, and the second heat exchanger 128 will hereinafter be made to a liquid.

Figure 3A:
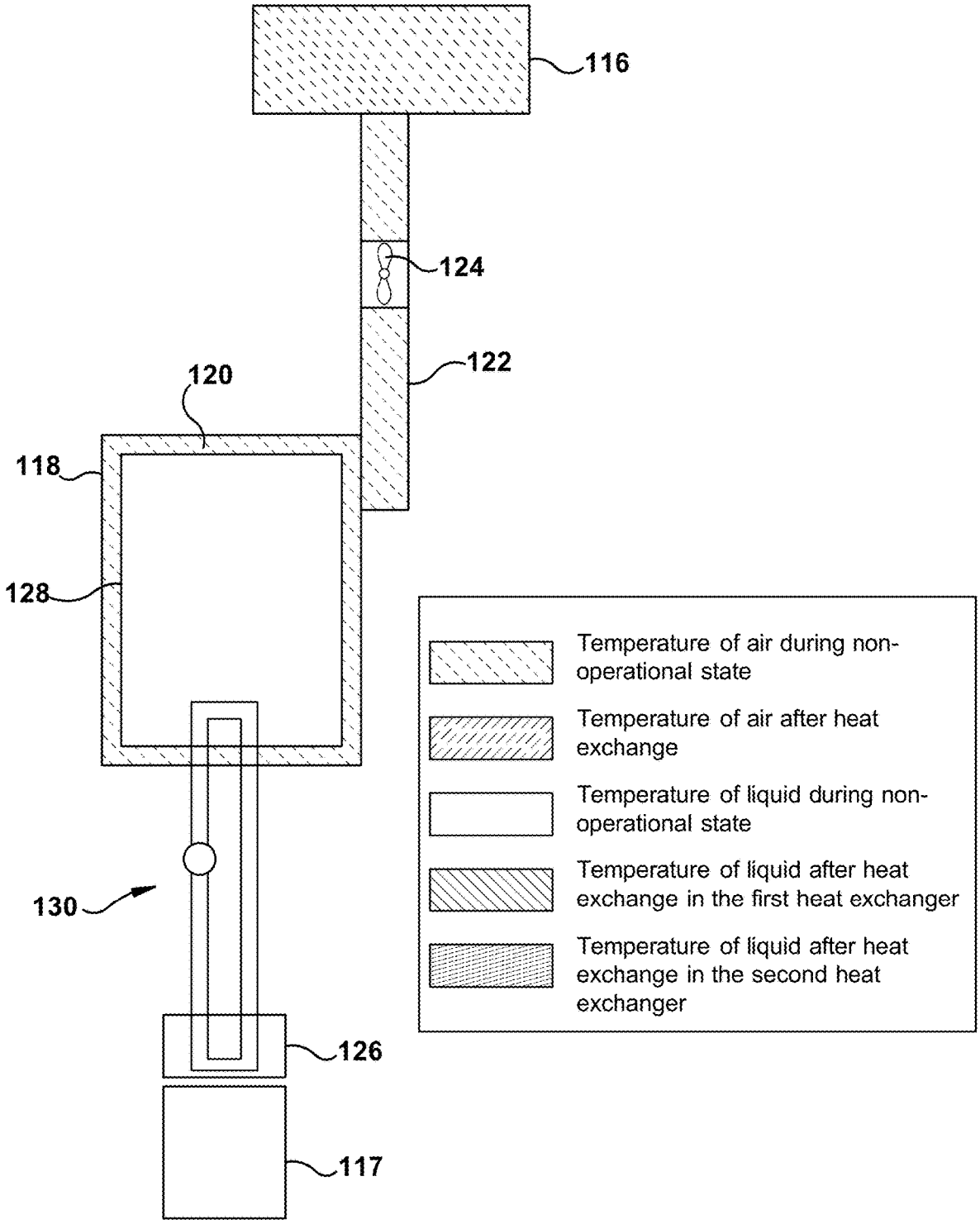
FIG. 3A is a schematic view of an air cooling system in FIG. 2A in a non-operational state.

As shown in FIG. 3A, the air cooling system is schematically depicted in a non-operational state where the liquid located within the fluid line 130 is static such that said liquid does not circulate therein. As such, a temperature of the liquid remains substantially constant (e.g., generally the above-freezing temperature of the fresh food compartment 102). Further, a temperature of the air within cooling area 120 of the insulated chamber 118 and a temperature of the air within the air duct 122 remains unchanged. Specifically, in the non-operational state, a temperature of the air within the cooling area 120 and the air duct 122 is likewise generally the above-freezing temperature of the fresh food compartment 102.

In the non-operational state, the temperature of air that enters the ice maker 116 is not ideal for ice piece manufacturing, since it is likely above the freezing temperature of water. As such, when ice piece manufacturing is desired, the air cooling system enters an operational state to cool the air within the cooling area 120 of the insulted chamber 118 and the air within the air duct 122. The activation of the air cooling system can initiate by a signal from a controller upon the need to make ice, user interaction, etc.

Figure 3B:
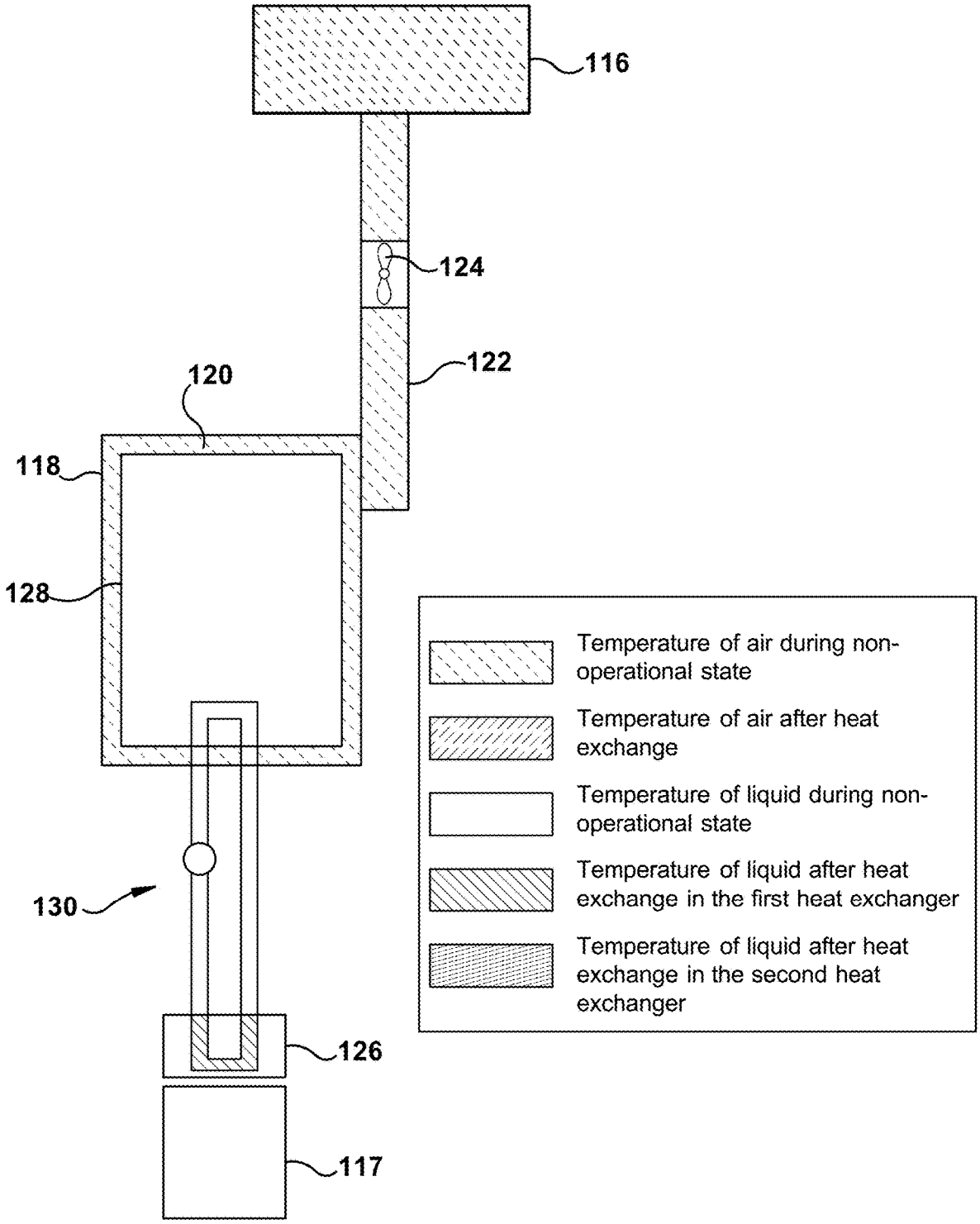
FIG. 3B is a schematic view of the air cooling system in an operational state at a first time period.

Moving on to FIG. 3B, after the air cooling system enters the operational state, the liquid within the first heat exchanger 126 is cooled via heat exchange with the freezer evaporator 117. That is, because the temperature surrounding the freezer evaporator 117 is cooler than that of the liquid within the first heat exchanger 126, and due to the close proximity of the first heat exchanger 126 to the freezer evaporator 117, the temperature of the liquid within the first heat exchanger 126 decreases.

Figure 3C:
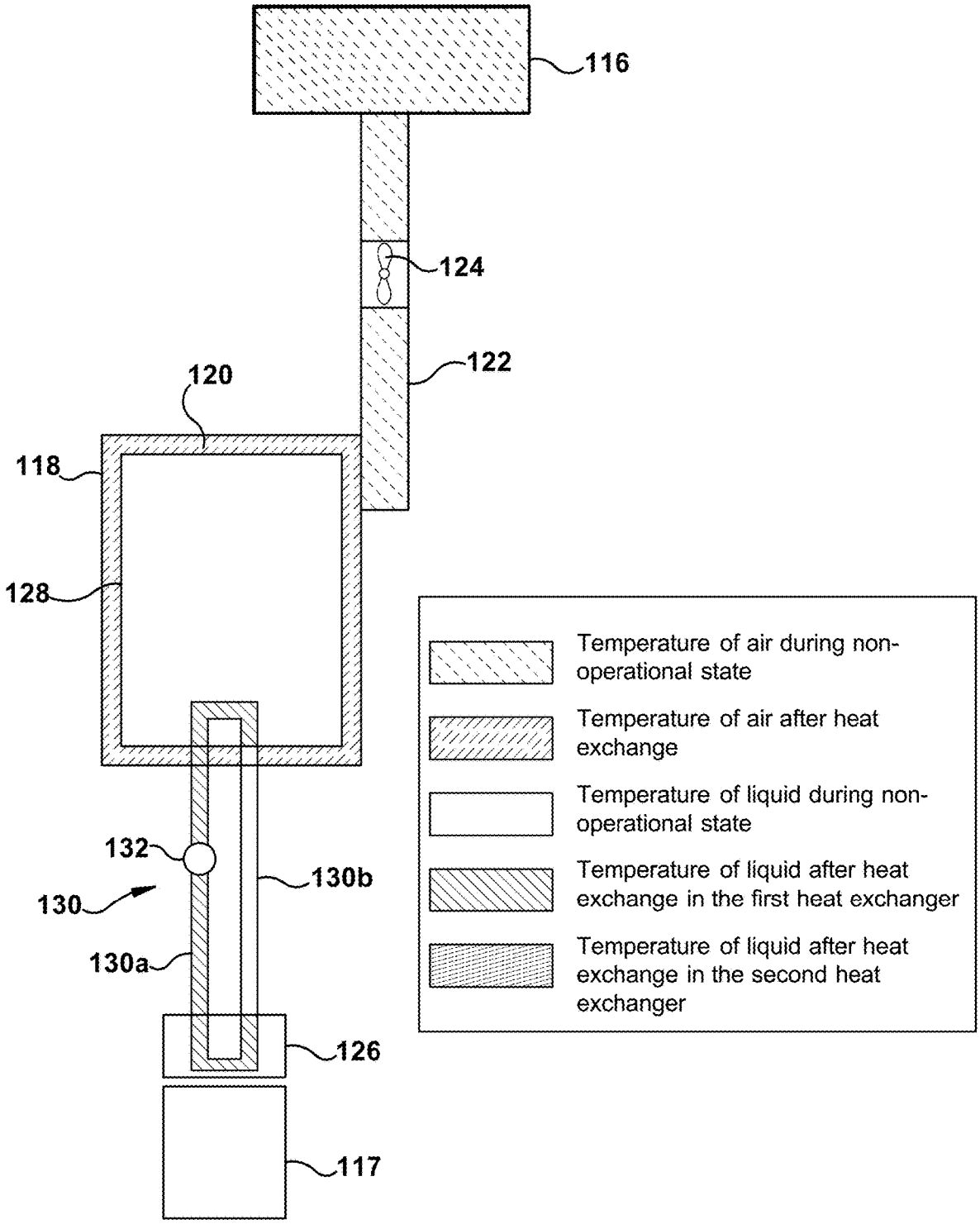
FIG. 3C is a schematic view of the air cooling system in the operational state at a second time period.

Thereafter, as shown in FIG. 3C, the pump 132 is activated to circulate the liquid within the fluid line 130. Specifically, the initially cooled liquid (i.e., the liquid cooled via heat exchange between the freezer evaporator 117 and the first heat exchanger 126) flows from the first heat exchanger 126, through the first pipe 130*a*, and into the second heat exchanger 128. Heat exchange between the cooled liquid within the second heat exchanger 128 and the air within the cooling area 120 of the insulated chamber 118 occurs and results in a decrease in temperature of the air within the cooling area 120. That is, after said heat exchange, the temperature of the air within the cooling area 120 is less than the temperature of the air within the air duct 122, and preferably is less than 10° F., more preferably 5-10° F. (or less).

Figure 3D:
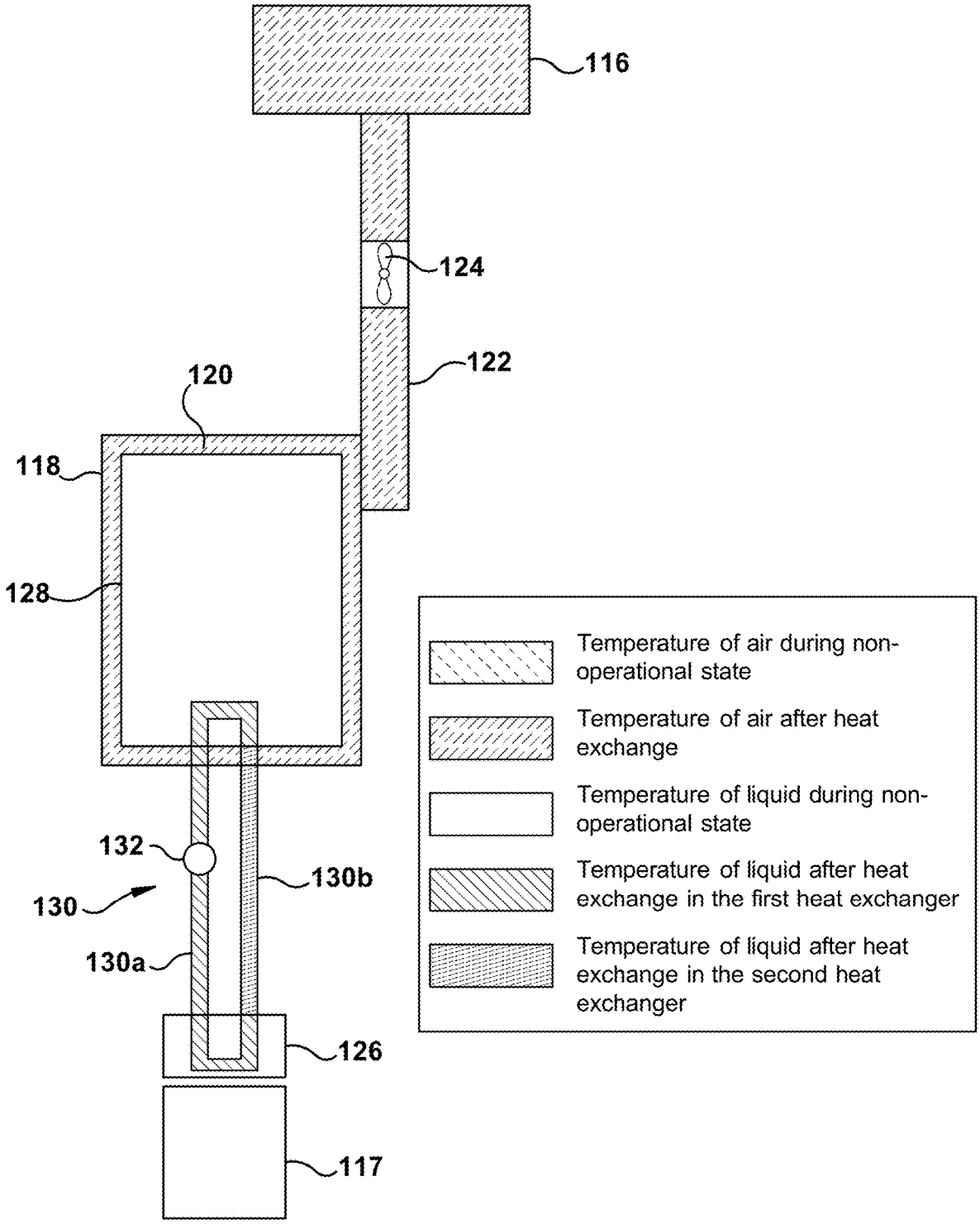
FIG. 3D is a schematic view of the air cooling system in the operational state at a third time period.

With reference to FIG. 3D, the cooled air within the cooling area 120 can then be directed to the ice maker 116 via the fan 124. That is, activation of the fan 124 actively forces the cooled air within the cooling area 120 to flow to the ice maker 116 via the air duct 122. Optionally, the fan 124 (and/or the pump 132) could be temporarily deactivated when one of the refrigerator doors 112L, 112R are open to inhibit cold air transfer out of the air duct 122 into the ambient environment. Moreover, as shown, after the cooled liquid within the second heat exchanger 128 has undergone heat exchange with the air within the cooling area 120, said liquid is then circulated from the second heat exchanger 128 back to the first heat exchanger 126 via the second pipe 130*b*. In other words, because the temperature of the air within the cooling area (prior to heat exchange) is greater than the temperature of the cooled liquid within the second heat exchanger 128, heat is transferred such that the air within the cooling area 120 becomes cooler (preferably below the freezing temperature of water) and the liquid within the second heat exchanger 128 becomes warmer. As such, the warmed liquid (i.e., the liquid in the fluid line 130 that has undergone heat exchange with the air within the cooling area 120) is then transported back to the first heat exchanger 126 to undergo the initial heat exchange with the freezer evaporator 117.

During operation of the pump 132 (i.e., while the liquid circulates between the first and second heat exchangers 126, 128), it is possible that frost may accumulate on the second heat exchanger 128. So as to hinder or prohibit an accumulation of frost thereon, the refrigerator 100 may include a defrost system which operates periodically, or optionally may even sense the presence of frost on the second heat exchanger 128 (e.g., via a sensor, not shown), to prevent further accumulation thereon or remove frost that has already accumulated thereon. For example, during a periodic defrost cycle, or optionally if the presence of frost is detected on the second heat exchanger 128, a controller (not shown) can deactivate operation of the pump 132 in order to raise the temperature of the liquid circulating between the first and second heat exchangers 126, 128. In doing so, the relatively warmer temperature of the liquid will remove frost accumulated on the second heat exchanger 128.

Alternatively, the defrost system may function to first raise the temperature of the liquid circulating between the first and second heat exchangers 126, 128 (e.g., via a defrost heater for the freezer evaporator 117 that raises the temperature of the freezer evaporator 117 to melt the frost thereon) and subsequently continue to circulate the liquid therebetween. In doing so, the relatively warmer temperature of the liquid entering the second heat exchanger 128 will increase the temperature thereof and melt or remove frost accumulated thereon. In yet another alternative embodiment, the second heat exchanger 128 may have a dedicated defrost heater (not shown) associated therewith that is configured to remove any frost accumulated thereon. Regardless of the configuration, the refrigerator 100 further includes a drain (not shown) that directs the water (i.e., resulting from the frost being melted) to a downstream location either inside or outside of the refrigerator 100.

It is to be understood that the above-discussed method of providing cool air to the ice maker 116 may occur in a different order of steps. For example, the initial cooling of the liquid within the first heat exchanger 126 can occur during the non-operational state. That is, during normal use of the refrigerator and prior to activation of the air cooling system, the liquid within first heat exchanger 126 may be inadvertently cooled due to its location with respect to the freezer evaporator 117. In another example, the liquid within the fluid line 130 can begin circulating between the first and second heat exchangers 126, 128 before the liquid within the first heat exchanger 126 undergoes cooling due to heat exchange with the freezer evaporator 117.

As briefly mentioned, the air cooling system detailed above can be employed in a refrigerator having a different configuration than that shown in FIG. 1. For example, with reference to FIG. 4, the refrigerator 100 may again include left-hand and a right-hand fresh food doors 112L, 112R that collectively provide selective access to a fresh food compartment 102. Additionally, the refrigerator 100 includes a freezer compartment 104 and a variable climate zone ("VCZ") compartment 105 disposed adjacent one another and both positioned underneath the fresh food compartment 102. The temperature of the VCZ compartment 105 is adjustable such that the temperature therein can be equivalent to either that of the fresh food compartment 102 or the freezer compartment 104, or another temperature in between. A freezer door 114 is pivotably secured to the cabinet and provides selective access to the freezer compartment 104. Likewise, a VCZ door 115 is pivotably secured to the cabinet and provides selective access to the VCZ compartment 105.

As shown, the air cooling system is located in substantially the same manner. That is, the freezer evaporator 117 and the first heat exchanger 126 are provided in the freezer compartment 104 whereas the second heat exchanger 128 is disposed in the insulated chamber 118 located within the fresh food compartment 102.

Figure 5:
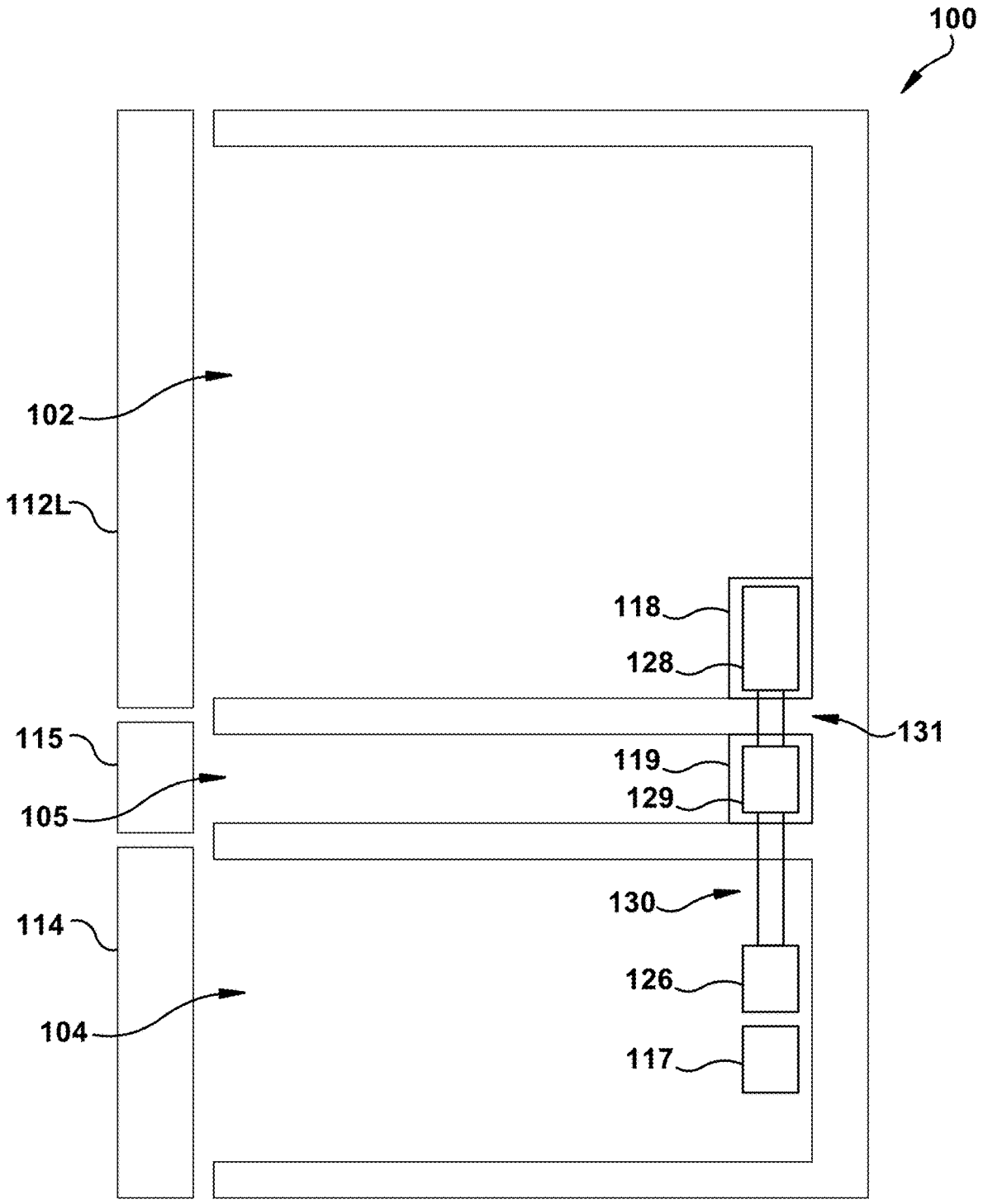
FIG. 5 is a side cross-sectional schematic view of an alternative refrigerator employing an air cooling system.

In yet another alternative embodiment of a refrigerator 100, as shown in FIG. 5, the VCZ compartment 105 is disposed vertically between the fresh food compartment 102 and the freezer compartment 104. Access to the VCZ compartment 105 is via a slidable VCZ drawer, and likewise access to the freezer compartment 104 is via a slidable freezer drawer. In this configuration, the air cooling system includes an additional, third heat exchanger 129 positioned within a separate insulated chamber 119 located within the VCZ compartment 105. The air cooling system includes a first fluid line 130 that circulates a first fluid (i.e., liquid) between the first and third heat exchangers 126, 129. Further, a second fluid line 131 circulates a different, second fluid (i.e., liquid) between the second and third heat exchangers 128, 129. Alternatively, the air cooling system can include only a single fluid line (e.g., fluid line 130) that fluidly connects all of the first, second, and third heat exchangers 126, 128, 129. The method of providing cool air to an ice maker (not shown) is substantially the same as described above, and will not be discussed further, for brevity.

Figure 6:
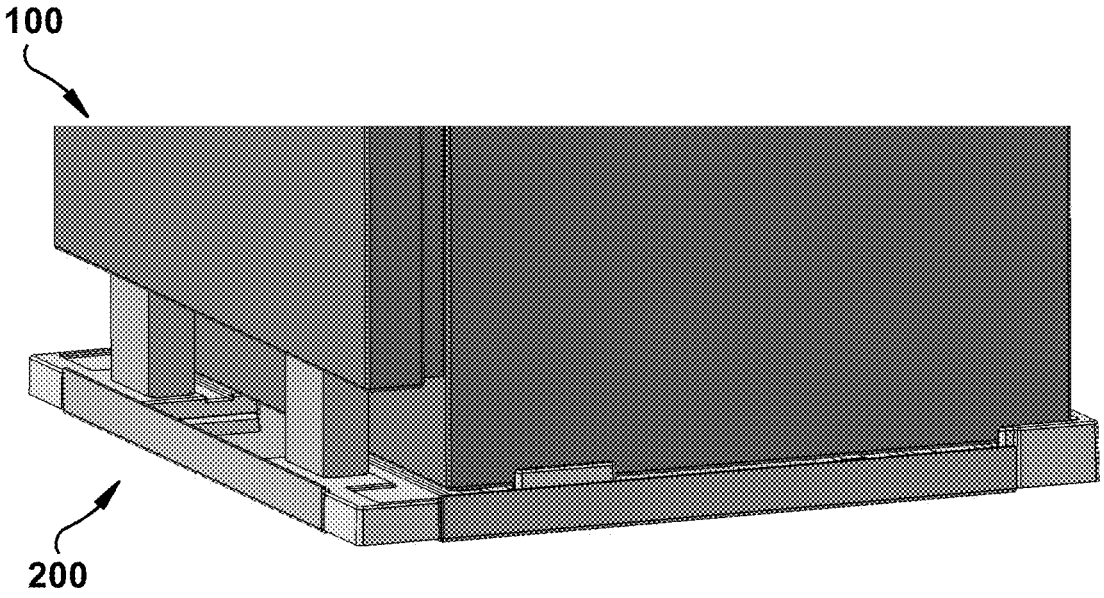
FIG. 6 is a partial perspective view of a bottom of a refrigerator and a door support.
Figure 7:
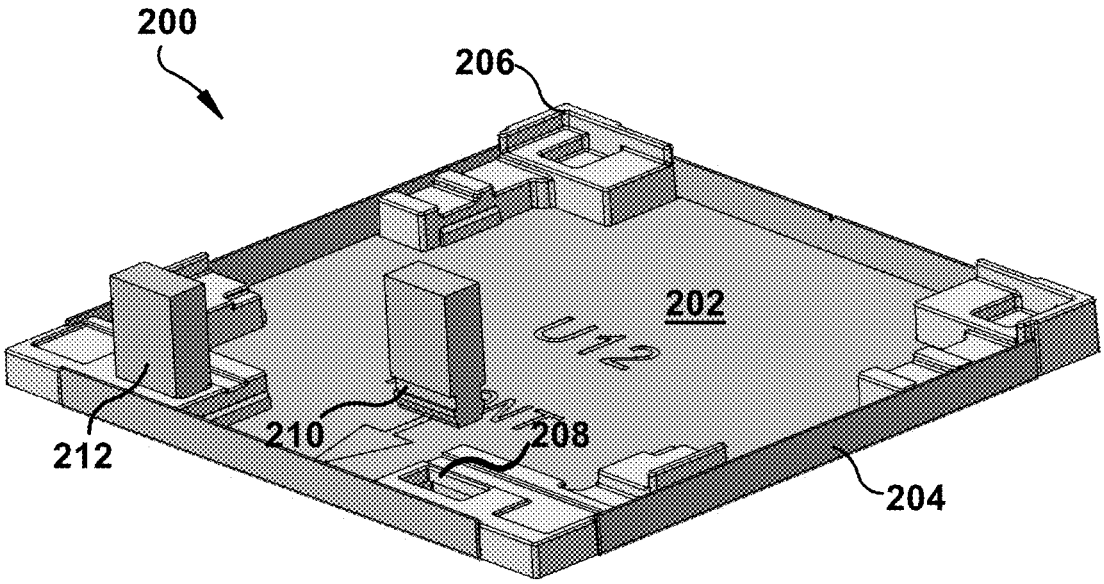
FIG. 7 is a perspective view of the door support shown in FIG. 6.

In a separate embodiment, as shown in FIG. 6, a bottom portion of the refrigerator 100 is shown. A door support 200 is disposed underneath the refrigerator 100 and is configured to support the refrigerator 100 during manufacturing and/or shipping. The door support 200 can be made from various materials (e.g., expanded polystyrene foam). As shown in FIG. 7, the door support 200 comprises a base 202 having a bounded wall 204 extending upwards therefrom. Pads 206 are positioned at each of the corners of the base 202. At least two of the pads 206 include apertures 208 configured to accept a locking portion 210 of a support leg 212. Specifically, in an installed position, the support leg 212 contacts a bottom surface of a door in order to support the door.

Figure 8:
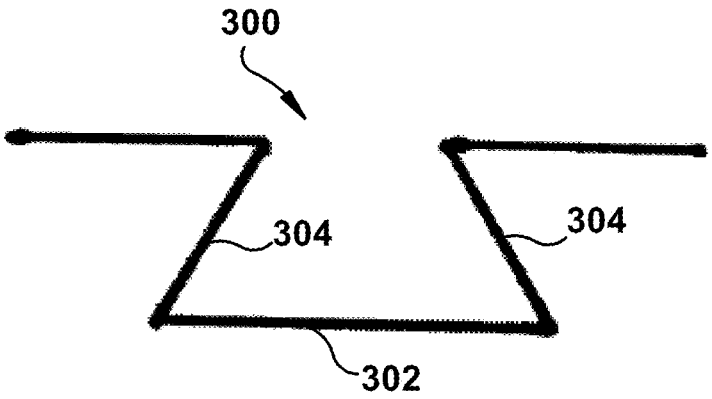
FIG. 8 is a top sectional view of a portion of a liner of a refrigerator.
Figure 9:
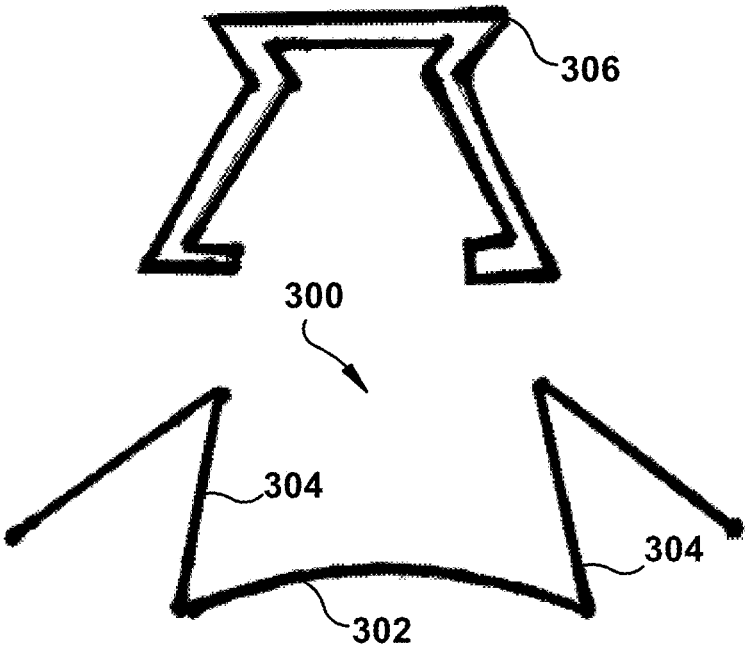
FIG. 9 is a top sectional view of a component configured to be inserted into the portion of the liner shown in FIG. 8.

In another separate embodiment, as depicted in FIGS. 8 and 9, a top cross-sectional portion of the inner liner is shown. Specifically, the portion of the inner liner could be on any one of the walls of the inner liner (e.g., the top wall 108*a*, the bottom wall 108*b*, the rear wall 108*c*, and/or the pair of opposing side walls 108*d*). A recess 300 is formed in the liner such that a rear wall 302 of the recess 300 extends towards the structural outer housing 106. Further, sidewalls 304 of the recess 300 are angled such that each sidewall creates an acute angle with respect to the rear wall 302.

Figure 10:
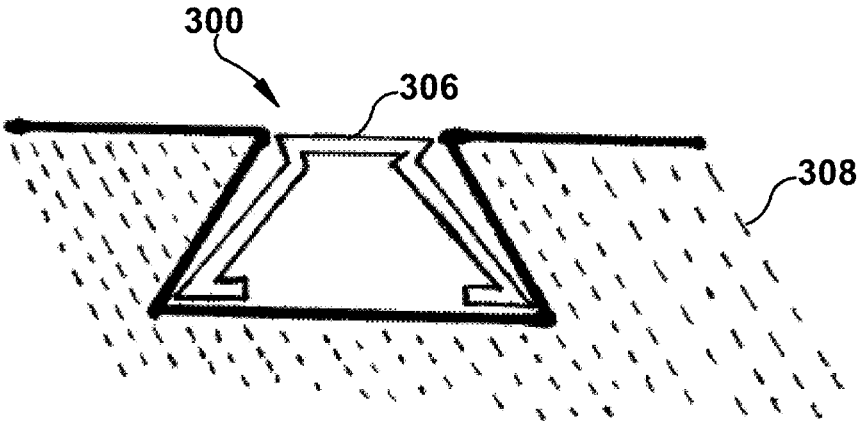
FIG. 10 is a top sectional view of the component shown in FIG. 9 inserted into the portion of the liner.

The recess 300 is shaped and sized to accept a component 306 therein. In order to insert the component 306 within the recess 300, the inner liner is deformed such that the angles between the sidewalls 304 and the rear wall 302 increase. When the recess 300 is deformed, the component 306 can then be inserted therein. As shown in FIG. 10, after the component 306 has been installed within the recess 300, the force applied to the inner liner is removed, thereby allowing the inner liner to revert back to its original shape. Thereafter, insulation (e.g., foam) 308 can be filled in between the inner liner and the structural outer housing 106.

Figure 11:
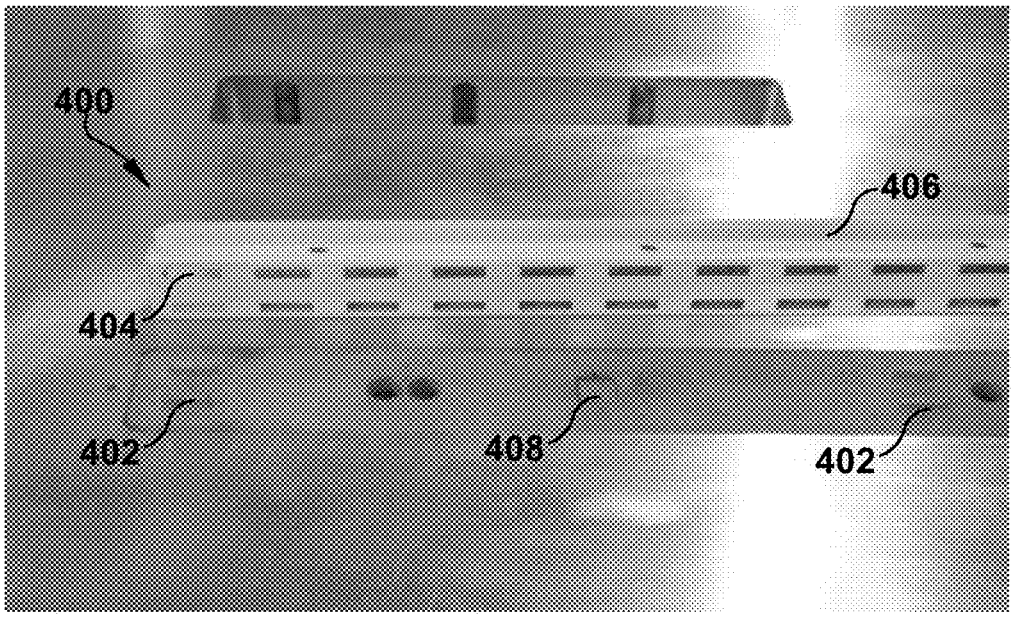
FIG. 11 is a perspective side view of a forming tool.

In a further separate embodiment, with respect to FIG. 11, a manufacturing method of attaching components (e.g., rails, racks, hardware or other preformed shapes) to a refrigerator liner is discussed. Specifically the components are overformed into a liner during a thermoforming process. As shown in FIG. 11, the method includes providing a forming tool 400 with embedded features 402 that are devised to engage mating features 404 of a component 406. The embedded features 402 help properly align the component 406 onto the forming tool 400. The forming tool 400 may also include magnets 408 that securely hold the component 406 onto the forming tool 400 when the inserted component 406 is metallic.

Figure 12:
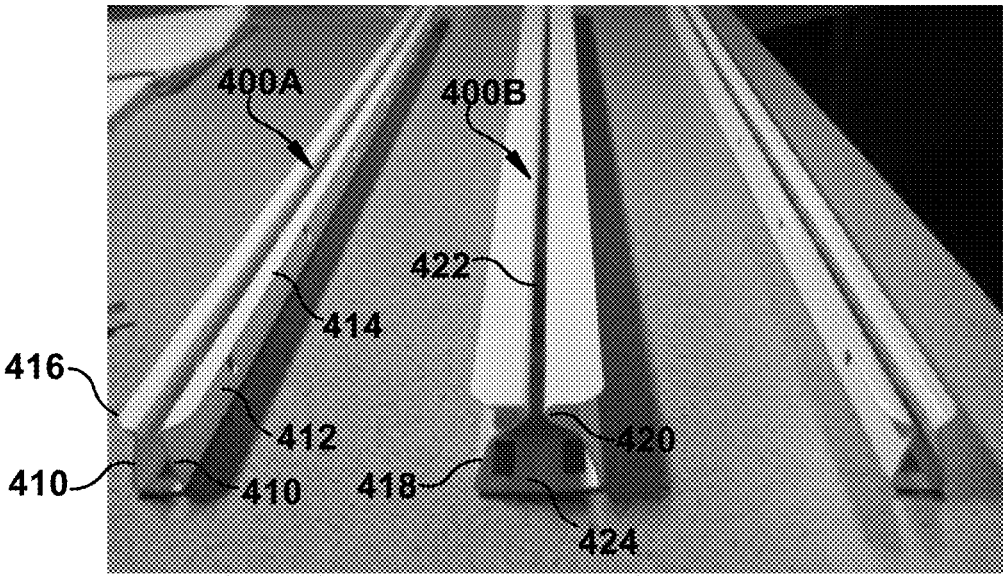
FIG. 12 is a front perspective view of a component of the forming tool shown in FIG. 11.

In addition, features are added to the thermoformed components 406 to allow for greater "envelopment" where beneficial, and limited envelopment where detrimental. Referring to FIG. 12, a component 400A may include two L-shaped legs 410. The L-shaped legs 410 are shown to extend inwardly at a first sloped portion 412 before extending outwardly at a second portion 414. The L-shaped legs 410 may also include rounded distal ends 416 that help prevent the liner from cracking proximate the corners 416, which can become problematic when thermoforming around sharp corners.

Figure 13A:
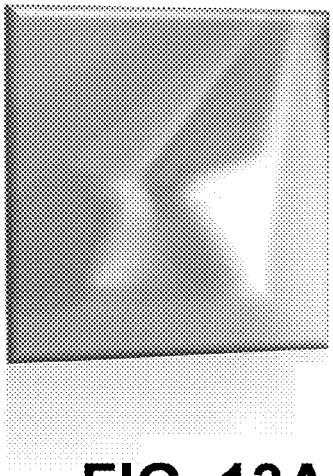
FIG. 13A is a front perspective view of the refrigerator liner formed via the forming tool.
Figure 13B:
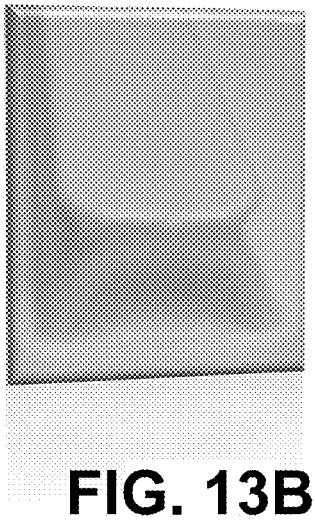
FIG. 13B is a front perspective view of the refrigerator liner formed via the forming tool.

As further shown in FIG. 12, a component 400B may also include two generally L-shaped legs 418 wherein heels 420 of the legs 418 are in close proximity such that a gap 422 between the heels 420 of the legs 418 is minimized. This configuration helps constrain the liner material from entering into a space 424 between the legs 418, as is evidenced in FIGS. 13A-13B.

Figure 14A:
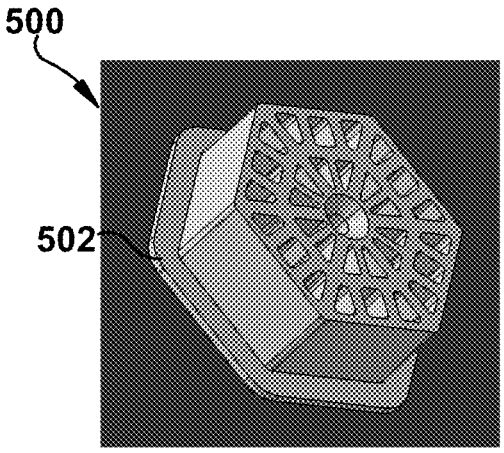
FIG. 14A is a perspective view of an anchor nut.
Figure 14B:
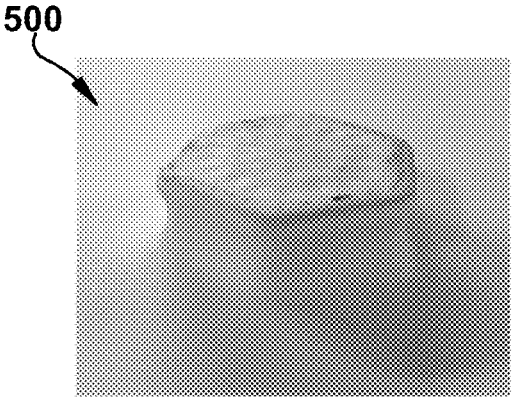
FIG. 14B is a perspective view of the anchor nut shown in FIG. 14A surrounded by the liner.

In still another embodiment, with respect to FIG. 14A, a hexagonally-shaped anchor nut 500 can be secured to the liner. The anchor nut 500 is placed on a forming fixture such that the inner liner is then formed around the anchor nut 500 as shown in FIG. 14B. In particular, the inner liner is formed around a flange 502 that extends outwardly from one end of the anchor nut 500. The flange 502 enables the thermoformed liner to grasp and pull the anchor nut 500 away from the forming fixture after the liner is overformed around the anchor nut 500.

Figure 15:
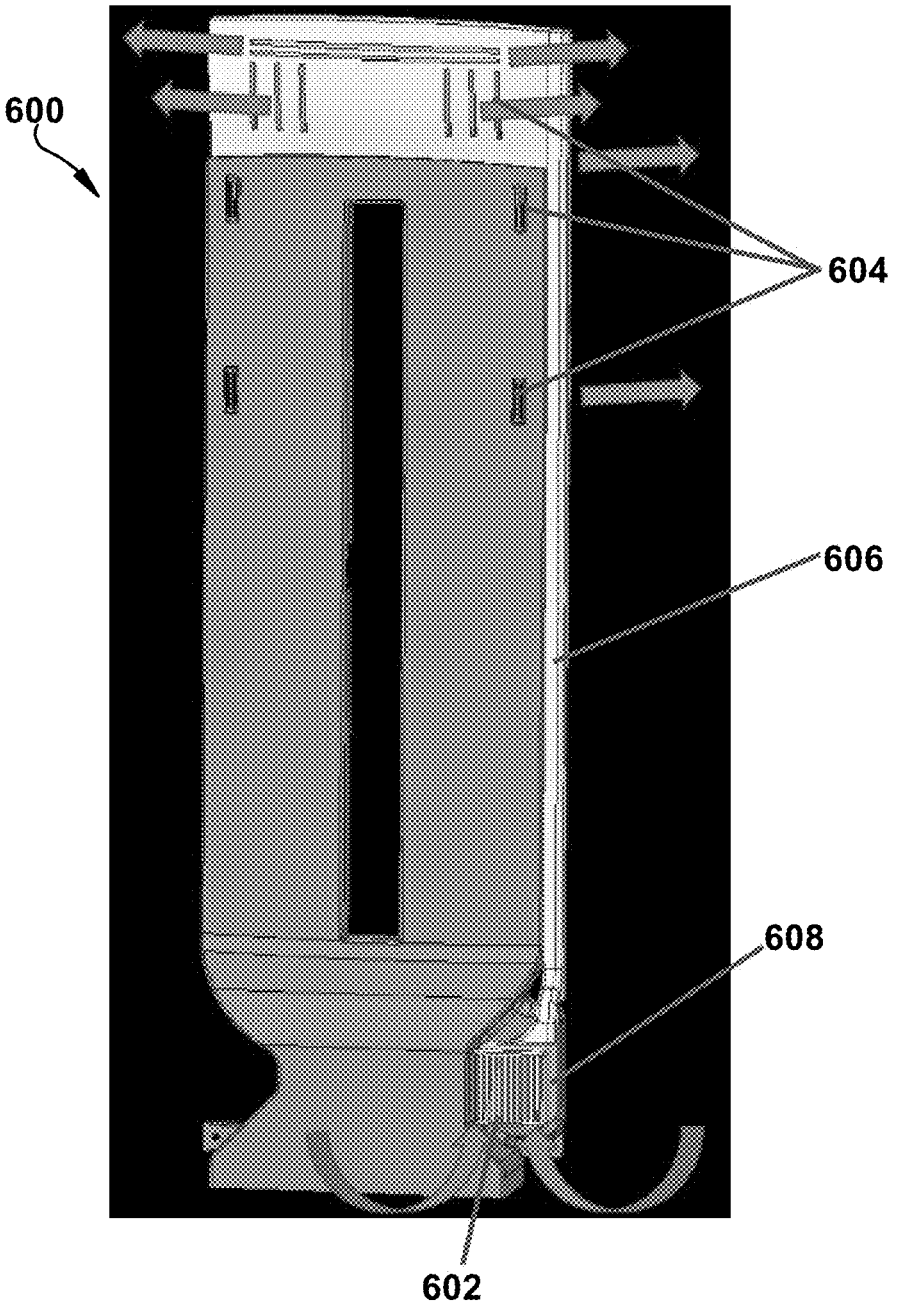
FIG. 15 is a front perspective view of an air tower.

In yet another embodiment, as shown in FIG. 15, an air tower 600 is shown. Specifically, in refrigerators having a bottom-mount configuration where only a single evaporator is used to cool both the fresh food and freezer compartments 102, 104, temperature stratification occurs due to the buoyancy of air and a heat load of the cabinet 106. That is, there is a natural stratification of temperature within the refrigerator 100 because warm air rises and cooler air sinks. This is further emphasized because the freezer compartment 104 is disposed below the fresh food compartment 102.

To reduce the above-noted temperature stratification, an air tower 600 is used to guide the lower (cool) air and traverse said air to a higher point (i.e., where the air is warmer). Specifically, an inlet 602 is shown at a bottom portion of the air tower 600. Air enters the inlet 602 and is directed upwards to outlets 604 disposed at a top portion of the air tower 600 via ducts 606. The air tower 600 further includes a fan 608 to force the air into the ducts 606.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A refrigerator comprising:

a cabinet defining a storage compartment therein;

a door that provides selective access to the storage compartment;

an ice maker provided in the door;

an air duct that directs a flow of air from an insulated chamber to the ice maker, wherein the insulated chamber defines a cooling area that is isolated from a temperature of the storage compartment;

an evaporator; and an air cooling system that cools air inside the insulated chamber, the air cooling system comprising:

a first non-evaporative heat exchanger provided independent of and adjacent to the evaporator;

a second non-evaporative heat exchanger provided within the cooling area of the insulated chamber; and a fluid line that directs a circulation of fluid between the first and second non-evaporative heat exchangers, the first non-evaporative heat exchanger provided in heat exchanging relationship with the evaporator to cool the fluid positioned in the first non-evaporative heat exchanger, and the second non-evaporative heat exchanger provided in heat exchanging relationship with the air inside the insulated chamber to cool the air therein.

2. The refrigerator of claim 1, further comprising a horizontal mullion that separates the storage compartment into a fresh food compartment and a freezer compartment, the fresh food compartment being located above the freezer compartment.

3. The refrigerator of claim 2, the insulated chamber being located within the fresh food compartment and both the evaporator and the first non-evaporative heat exchanger being located within the freezer compartment.

4. The refrigerator of claim 3, the fluid line extending through the horizontal mullion.

5. The refrigerator of claim 4, the fluid line comprising a first pipe and a second pipe, the first pipe directing the fluid from the first non-evaporative heat exchanger to the second non-evaporative heat exchanger, and the second pipe directing the fluid from the second non-evaporative heat exchanger to the first non-evaporative heat exchanger.

6. The refrigerator of claim 4, further comprising a pump in fluid communication with the fluid line, the pump circulating the fluid within the fluid line.

7. The refrigerator of claim 6, the pump being positioned within the horizontal mullion.

8. The refrigerator of claim 3, the insulated chamber being positioned adjacent a rear wall of the fresh food compartment, and the air duct positioned about a section of the cabinet that defines the fresh food compartment.

9. The refrigerator of claim 8, further comprising a fan disposed at the air duct.

10. The refrigerator of claim 3, the door comprising a fresh food door and a freezer door, the fresh food and freezer doors disposed to provide selective access to the fresh food and freezer compartments, respectively, and the ice maker provided in the fresh food door.

11. The refrigerator of claim 10, further comprising first and second gaskets disposed at an outlet of the air duct and an inlet of the ice maker, respectively, the first and second gaskets provided to fluidly connect the air duct and the ice maker when the door is in a closed position.

12. The refrigerator of claim 1, wherein the fluid is glycol.

13. A bottom mount refrigerator having a fresh food compartment separated from and disposed above a freezer compartment, the refrigerator comprising:

a cabinet defining a storage compartment including the fresh food compartment and the freezer compartment;

an ice maker provided in a door that provides selective access to the fresh food compartment or the freezer compartment;

an air duct provided at the fresh food compartment that directs a flow of air from an insulated chamber provided in the fresh food compartment to the ice maker, wherein the insulated chamber defines a cooling area that is isolated from a temperature of the fresh food compartment;

an evaporator located within the freezer compartment, and an air cooling system that cools air inside the insulated chamber, the air cooling system comprising:

a first non-evaporative heat exchanger provided within the freezer compartment, independent of and adjacent to the evaporator;

a second non-evaporative heat exchanger spaced from the first heat exchanger and disposed within the cooling area of the insulated chamber; and a fluid line that directs a circulation of fluid between the first and second non-evaporative heat exchangers, the first non-evaporative heat exchanger provided in heat exchanging relationship with the evaporator to cool the fluid positioned in the first non-evaporative heat exchanger, and the second non-evaporative heat exchanger provided in heat exchanging relationship with the air inside the insulated chamber to cool the air therein.

14. The refrigerator of claim 13, the fluid line extending through a horizontal mullion that provides the separation of the fresh food compartment and the freezer compartment.

15. The refrigerator of claim 14, the fluid line comprising a first pipe and a second pipe, the first pipe directing the fluid from the first non-evaporative heat exchanger to the second non-evaporative heat exchanger, and the second pipe directing the fluid from the second non-evaporative heat exchanger to the first non-evaporative heat exchanger.

16. The refrigerator of claim 14, further comprising a fan positioned within the air duct, the fan creating the flow of air through the air duct.

17. The refrigerator of claim 14, wherein the fluid is a liquid.

18. A method of providing cold air to an ice maker provided in a door of a fresh food compartment, the method comprising the steps of:

circulating a liquid between a first non-evaporative heat exchanger and a second non-evaporative heat exchanger, the first non-evaporative heat exchanger positioned independent of and adjacent to an evaporator located within a freezer compartment, and the second non-evaporative heat exchanger provided in a cooling area defined by an insulated chamber located within the fresh food compartment, wherein the cooling area is isolated from a temperature of the fresh food compartment;

cooling a portion of said liquid via heat exchange with the evaporator, the cooled portion of said liquid being located within the first non-evaporative heat exchanger;

transporting the cooled portion of said liquid from the first non-evaporative heat exchanger to the second non-evaporative heat exchanger;

cooling air located within the insulated chamber via heat exchange between the cooled portion of said liquid and the air located within the insulated chamber; and directing a flow of said cooled air from the insulated chamber to the ice maker via an air duct.

19. The method of claim 18, further comprising the step of forcing said cooled air located within the insulated chamber into the air duct via a fan disposed within the air duct.

20. The method of claim 18, further comprising the step of transporting the cooled portion of said liquid from the second non-evaporative heat exchanger back to the first non-evaporative heat exchanger.

* * * * *